US006089323A

United States Patent [19]

Newman et al.

[11] Patent Number: 6,089,323

[45] **Date of Patent: *Jul. 18, 2000**

[54] TRACTOR SYSTEM

[75] Inventors: Kenneth R. Newman, Willis; Nelson A. Haver, Houston, both of Tex.

[73] Assignee: CTES, L.C., Conroe, Tex.

[ * ] Notice: This patent is subject to a terminal disclaimer.

[21] Appl. No.: 09/318,502

[22] Filed: May 25, 1999

Related U.S. Application Data

[62] Division of application No. 09/103,868, Jun. 24, 1998, which is a division of application No. 08/675,176, Jul. 3, 1996, Pat. No. 5,794,703.

[51] Int. Cl.[7] ..... E21B 23/00

[52] U.S. Cl. ..... 166/381; 166/206; 175/99

[58] Field of Search ..... 166/50, 206, 243, 166/381, 383; 175/99

[56] References Cited

U.S. PATENT DOCUMENTS

| | | | |
|---|---|---|---|
| 3,307,631 | 3/1967 | Coberly et al. | 166/75 |
| 3,313,346 | 4/1967 | Cross | 166/5 |
| 3,346,045 | 10/1967 | Knapp et al. | 166/5 |
| 3,559,905 | 2/1971 | Palynchuk | 242/54 |
| 3,724,567 | 4/1973 | Smitherman | 175/203 |
| 3,841,407 | 10/1974 | Bozeman | 166/315 |
| 4,050,384 | 9/1977 | Chapman | 104/138 G |
| 4,071,086 | 1/1978 | Bennett | 166/177 |
| 4,095,655 | 6/1978 | Still | 175/19 |
| 4,112,850 | 9/1978 | Sogel-Gfeller | 104/138 G |
| 4,141,414 | 2/1979 | Johansson | 175/99 X |
| 4,177,734 | 12/1979 | Rhoden | 104/138 G |
| 4,192,380 | 3/1980 | Smith | 166/250 |
| 4,223,737 | 9/1980 | O'Reilly | 166/362 |
| 4,244,296 | 1/1981 | Vertut | 104/138 G |
| 4,369,713 | 1/1983 | Richardson | 104/138 G |
| 4,372,161 | 2/1983 | de Buda et al. | 73/432 R |
| 4,403,551 | 9/1983 | Slight | 104/138 G |
| 4,463,814 | 8/1984 | Heretmeyer | 175/45 |
| 4,522,129 | 6/1985 | Jerberyd | 104/138 G |
| 4,537,136 | 8/1985 | Douglas | 104/138 G |
| 4,558,751 | 12/1985 | Huffaker | 175/99 |
| 4,654,102 | 3/1987 | Tolino et al. | 358/100 |
| 4,686,653 | 8/1987 | Staron et al. | 175/99 X |
| 4,770,105 | 9/1988 | Takagi et al. | 104/138.2 |
| 4,838,170 | 6/1989 | Illakowicz | 104/138.2 |
| 4,862,808 | 9/1989 | Hedgcoxe et al. | 104/138.2 |
| 4,919,223 | 4/1990 | Egger et al. | 180/8.1 |
| 4,940,095 | 7/1990 | Newman | 166/378 |
| 4,981,080 | 1/1991 | Elstone, III | 104/138.2 |
| 5,018,451 | 5/1991 | Hapstack | 104/138.2 |
| 5,060,737 | 10/1991 | Mohn | 175/104 |
| 5,080,020 | 1/1992 | Negishi | 104/138.2 |
| 5,121,694 | 6/1992 | Zollinger | 104/138.2 |
| 5,142,989 | 9/1992 | Suzumori et al. | 104/138.2 |
| 5,142,990 | 9/1992 | Leonard | 104/138.2 |

(List continued on next page.)

FOREIGN PATENT DOCUMENTS

| | | |
|---|---|---|
| 0149528 | 10/1985 | European Pat. Off. . |
| 93/302390 | of 1993 | European Pat. Off. . |
| 0 900 914 | 5/1997 | European Pat. Off. . |
| 2282170 | of 1993 | United Kingdom . |

OTHER PUBLICATIONS

"Coiled Tubing Services," Nowsco, 1995.

"Welltec Well Tractors," Welltec, 1995.

PCT/GB97/01868 PCT, Mar. 1997, Int'l Search Report (This is the PCT counterpart of the parent US Application).

*Primary Examiner*—Frank Tsay

*Attorney, Agent, or Firm*—Guy McClung

[57] ABSTRACT

A tractor system has been invented which, in certain embodiments, includes a body connected to the item, first setting means on the body for selectively and releasably anchoring the system in a bore, first movement means having a top and a bottom, the first movement means on the body for moving the body and the item, the first movement means having a first power stroke, and the tractor system for moving the item through the bore at a speed of at least 10 feet per minute.

24 Claims, 12 Drawing Sheets

U.S. PATENT DOCUMENTS

| | | | |
|---|---|---|---|
| 5,172,639 | 12/1992 | Wiesman et al. | 104/138.2 |
| 5,184,676 | 2/1993 | Graham et al. | 166/66.4 |
| 5,220,869 | 6/1993 | Pelrine et al. | 105/78 |
| 5,272,986 | 12/1993 | Smart | 104/138.2 |
| 5,293,823 | 3/1994 | Box | 104/138.2 |
| 5,309,844 | 5/1994 | Zollinger | 104/138.2 |
| 5,375,530 | 12/1994 | Zollinger et al. | 104/138.2 |
| 5,388,528 | 2/1995 | Pelrine et al. | 105/78 |
| 5,392,715 | 2/1995 | Pelrine | 164/138.2 |
| 5,435,395 | 7/1995 | Connell | 166/384 |
| 5,515,925 | 5/1996 | Boychuk | 166/379 |
| 5,788,002 | 8/1998 | Richter | 180/8.5 |
| 5,833,004 | 11/1998 | Coronado | 166/382 |
| 5,845,711 | 12/1998 | Connell et al. | 166/384 |

FIG. 1C1
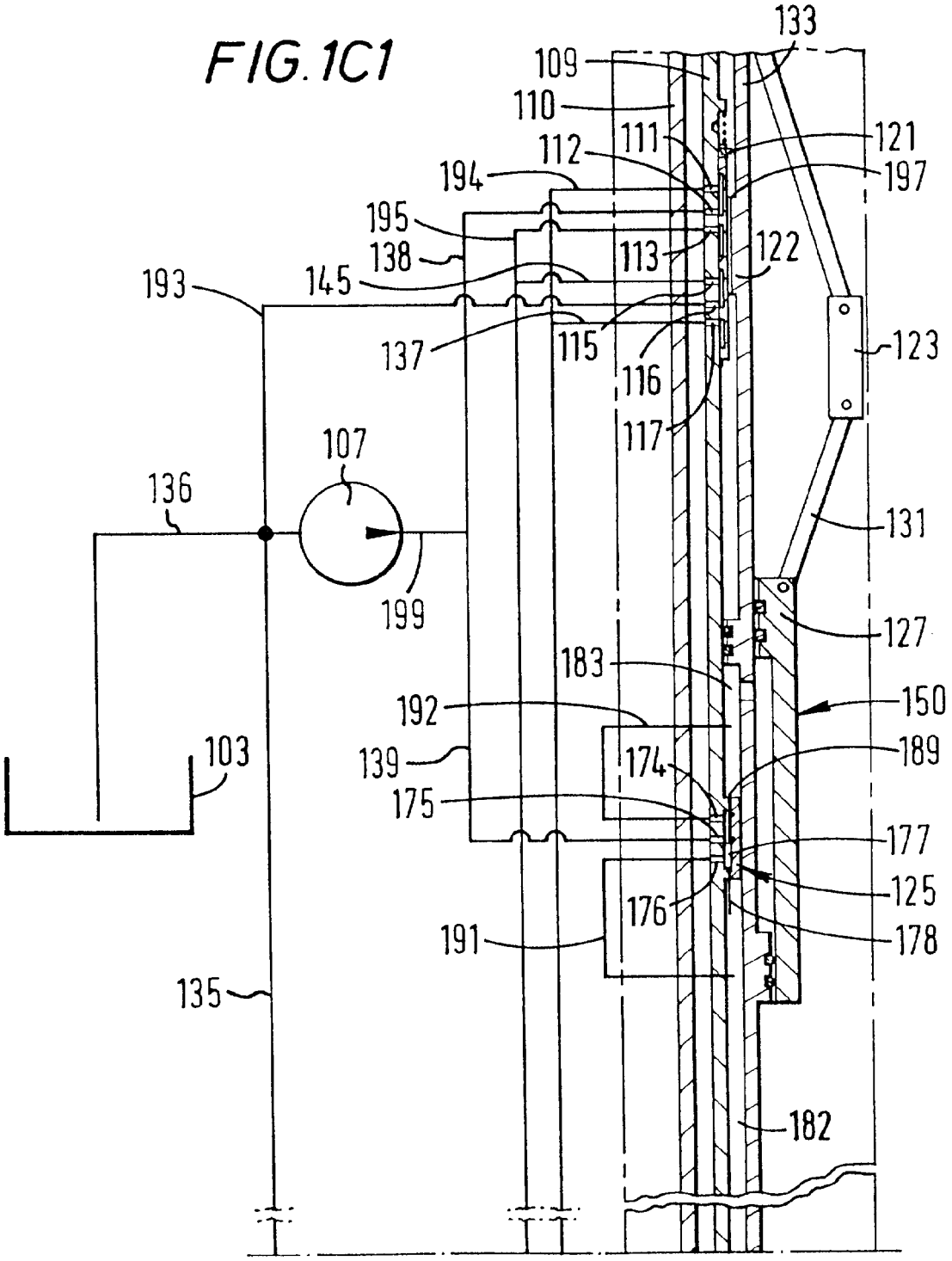

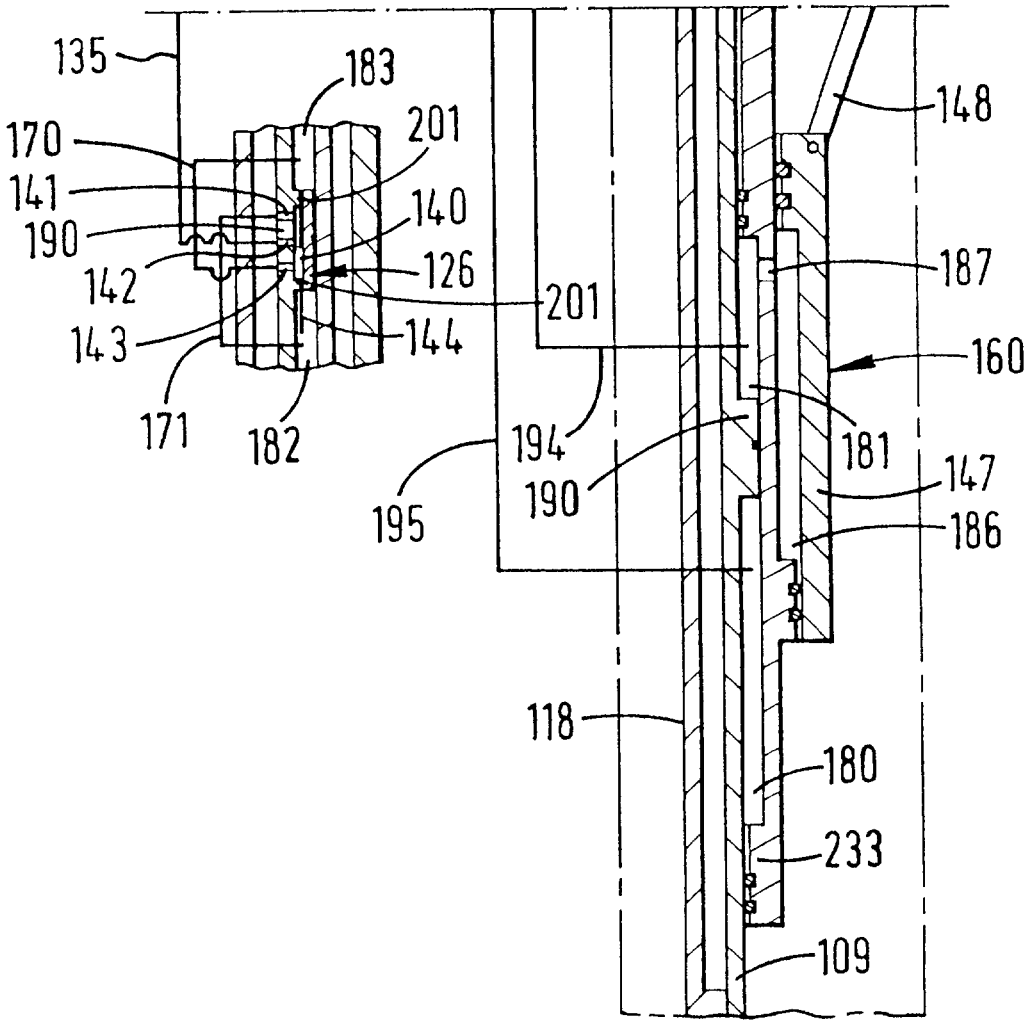
FIG. 1C2

600
620
610

620
(RETRACT)
600
610
(POWER)

600
620
(START POWER)
610
(POWER)

TRACTOR SYSTEM

RELATED APPLICATION

This is a division of U.S. Application Ser. No. 09/103,868 filed Jun. 24, 1998 entitled "Bore Tractor System" which is a division of U.S. Application Ser. No. 08/675,176 filed Jul. 3, 1996, now U.S. Pat. No. 5,794,703, both co-owned with the present invention and fully incorporated herein for all purposes.

BACKGROUND OF THE INVENTION

1. Field of the Invention

This invention is directed to wellbore tractors and, in one particular aspect, to a tractor system useful in a non-vertical wellbore to continuously move a tubular string, a wireline, a cable, or coiled tubing.

2. Description of Related Art

In vertical wellbores and semi-vertical wellbores which are not highly deviated, wirelines, cable, coiled tubing, tubular strings and tools introduced into the wellbore move down into the wellbore by the force of gravity. Gravity effects such movement when the wellbore is nearly vertical or is not deviated from vertical to such an extent that gravity forces the items against the wall of the wellbore rather than further into it.

Cable or wireline reaches a deviation threshold (e.g. for certain systems a deviation of about 70° from the vertical, e.g. wireline systems) at which gravity no longer provides the necessary force and resulting tension to move the cable or wireline down and through a wellbore.

To a certain extent tubulars and coiled tubing can be pushed through a deviated wellbore, even part of a horizontally or upwardly directed wellbore; but there is a limit to the length of coiled tubing that can be pushed in this manner. When compressive loads in a tubular become large enough, the tubular helically locks up in the wellbore (cased or uncased) and further movement is prevented. This is known as "helical lockup."

A variety of prior art wellbore tractors have been developed. For example U.S. Pat. No. 4,463,814 discloses an anchor-and-ram-unit assembly for propelling a drilling tool in a wellbore. The assembly has two anchor assemblies each with anchor feet that are hydraulically activated to move out and engage an interior wellbore wall. When a first anchor assembly is anchored, a movable piston moves by hydraulic fluid pressure down to move the drilling tool. When that piston reaches the limit of its movement, the second anchor assembly is set with its anchor feet engaging the wellbore. The first anchor assembly is then disengaged and a movable piston of the second anchor assembly is hydraulically activated to move the drilling tool. This system operates at relatively low speed and does not provide continuous motion of the drilling tool.

U.S. Pat. No. 4,095,655 discloses a low speed system for moving a drill bit laterally in a drilling operation. The system employs elastomers and reinforcing material operated in tension and has four hydraulically operated force cells on a thrust mandrel. Two of the force cells are lateral force cells expandable in a lateral direction, but of substantially fixed dimensions in the radial direction. The other two force cells are radial force cells, expandable radially, but having substantially constant lateral dimensions. In a typical operating sequence, with the lead lateral cell expanded, the lead radial cell is expanded to engage the walls of the borehole securely and effectively anchor itself to the borehole at that point. The lead lateral cell is then deflated, and the rear lateral cell correspondingly expanded to move the rear radial cell forward a distance corresponding to the difference in length between the rear lateral cell in its contracted and expanded positions. The rear radial cell is then expanded to engage the borehole walls, while the lead radial cell is contracted. Then the lead lateral cell is expanded while the rear lateral cell is contracted, to thereby move the lead portion of the mechanism forward a distance corresponding to the difference in length between a lateral cell in the expanded and contracted positions.

U.S. Pat. No. 4,223,737 discloses a method for preassembling a series of tubulars above the point of insertion into a wellbore in a horizontal mode and then moving the string of tubulars with a prime mover into a wellbore. The prime mover does not enter the wellbore.

Various known prior art wellbore tractor systems do not provide continuous movement. They operate in a stop-start mode or with a significant dwell time between anchoring and movement steps. Consequently the speed of such systems is relatively low, e.g. twenty feet or less per hour.

There has long been a need, recognized by the inventors of the present invention, for an efficient, effective and fast wellbore tractor system. There has long been a need for such a system which provides continuous or nearly continuous pulling of a cable, wireline, tubular string or coiled tubing. There has long been a need for such a system which, in certain embodiments, is small enough to pass through a small inner diameter tubular, but then is operable to work effectively in a larger inner diameter tubular. There has long been a need for such a system which operates effectively in a cased or uncased wellbore.

SUMMARY OF THE PRESENT INVENTION

The present invention, in certain embodiments, discloses a continuous or nearly-continuous motion wellbore tractor system which has at least one slip unit (and in certain embodiments two slip units) with retractable slips for engaging an interior wall of casing or of a wellbore and at least one movement unit for moving an item, e.g. but not limited to a tubular string, a cable, a wireline, or coiled tubing through a wellbore. In one aspect while the slip unit or slip units are involved in engaging and disengaging from a wellbore, the movement unit(s) move the item.

In one aspect of such a system with two slip units and two movement units power strokes of the movement units overlap so that there is no interruption in the motion of the item.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide new, useful, unique, efficient, nonobvious wellbore tractor devices and methods of their use; the present invention discloses, in certain embodiments a wellbore tractor system for moving an item through a wellbore, the wellbore extending from earth surface to an underground location, the system having a body connected to the item, first setting means on the body for selectively and releasably anchoring the system in a wellbore, first movement means on the body for moving the body and the item, the first movement means having a first power stroke, and the wellbore tractor system for moving the item through the wellbore at a speed of at least 100, 50, 10 or 5 feet per minute; such a wellbore tractor having second setting means on the body for selectively and releasably anchoring the system in the wellbore, the second setting means spaced apart from the first setting means, and second movement means on the body providing a second power stroke for moving the body and the item, the second movement means spaced apart from the first movement means; such a wellbore tractor system wherein the first power stroke temporally overlaps the second power stroke so that the item is moved continuously; such a wellbore tractor system wherein the first power stroke and the second power stroke are separated by a time period of no more than three minutes; such a wellbore tractor system wherein the first power stroke and the second power stroke are separated by a time period of no more than thirty seconds; such a wellbore tractor system wherein the item is a tubular string of interconnected tubular members; such a wellbore tractor system wherein the item is a string of coiled tubing; such a wellbore tractor system wherein the item is a wireline; such a wellbore tractor system including the item, the item having a lower end; such a wellbore tractor system having a payload secured to the lower end of the item; such a wellbore tractor system wherein the payload is a logging tool; such a wellbore tractor system wherein the first setting means includes a selectively movable first sleeve on the body, and first slip means pivotably connected to the selectively movable first sleeve for engaging an interior wall of the wellbore so that upon movement of the first sleeve in a first direction the first slip means is moved into engagement with the interior wall and upon movement of the first sleeve in a second direction the first slip means is moved out of engagement with the interior wall; such a wellbore tractor system with first hydraulic apparatus for moving the selectively movable first sleeve, the first hydraulic apparatus powered by fluid under pressure pumped into the hydraulic apparatus from the earth's surface through the item; such a wellbore tractor system with a selectively movable first sleeve on the body, and first slip means pivotably connected to the selectively movable first sleeve for engaging an interior wall of the wellbore so that upon movement of the first sleeve in a first direction the first slip means is moved into engagement with the interior wall and upon movement of the first sleeve in a second direction the first slip means is moved out of engagement with the interior wall, a selectively movable second sleeve on the body, and second slip means pivotably connected to the selectively movable second sleeve for engaging an interior wall of the wellbore so that upon movement of the second sleeve in a first direction the second slip means is moved into engagement with the interior wall and upon movement of the second sleeve in a second direction the second slip means is moved out of engagement with the interior wall; such a wellbore tractor system with first hydraulic apparatus for moving the selectively movable first sleeve, the first hydraulic apparatus powered by fluid under pressure pumped into the first hydraulic apparatus from the earth's surface through the item, and second hydraulic apparatus for moving the selectively movable second sleeve, the second hydraulic apparatus powered by fluid under pressure pumped into the second hydraulic apparatus from the earth's surface through the item; such a wellbore tractor system with first selectively operable control valve means on the body for selectively controlling the first setting means and the first movement means, and second selectively operable control valve means on the body for selectively controlling the second setting means and the second movement means; such a wellbore tractor system with the body including a mandrel with a composite exterior thread thereon, the composite exterior thread comprising a first power thread portion and a first retract thread portion interconnected with the first power thread portion, and a second power thread portion and a second retract thread portion interconnected with the second power thread portion, and a first follower pin connected to the first movement means, the first follower pin disposed for movement in the first power thread portion and in the first retract thread portion of the composite exterior thread of the mandrel, the first movement means moving the mandrel and the body by moving the first follower pin in the first power thread portion, and a second follower pin connected to the second movement means, the second follower pin disposed for movement in the second power thread portion and in the second retract thread portion of the composite exterior thread of the mandrel, the second movement means moving the mandrel and the body by moving the second follower pin in the first power thread portion; such a wellbore tractor system wherein the thread portions are sized, configured, and located so that the wellbore tractor system provides continuous motion for the item to continuously move the item into the wellbore.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 1C1 and 1C2 are enlargements of a portion of the system of FIG. 1A and includes a schematic representation of an hydraulic circuit of the system.

DESCRIPTION OF EMBODIMENTS PREFERRED AT THE TIME OF FILING FOR THIS PATENT

Figure 1A:
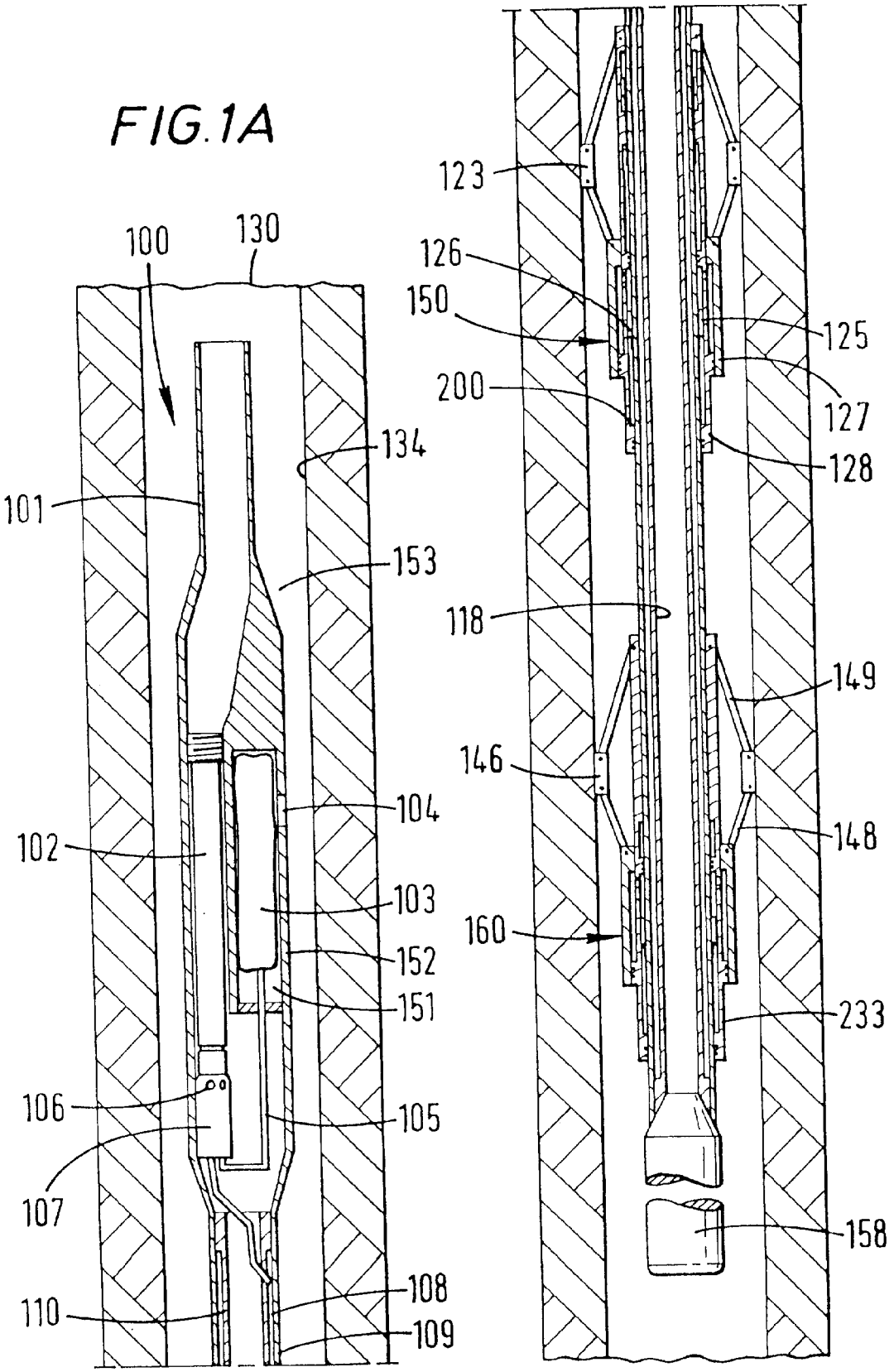
FIG. 1A is a side view in cross-section of a wellbore tractor system according to the present invention.
Figure 2A:
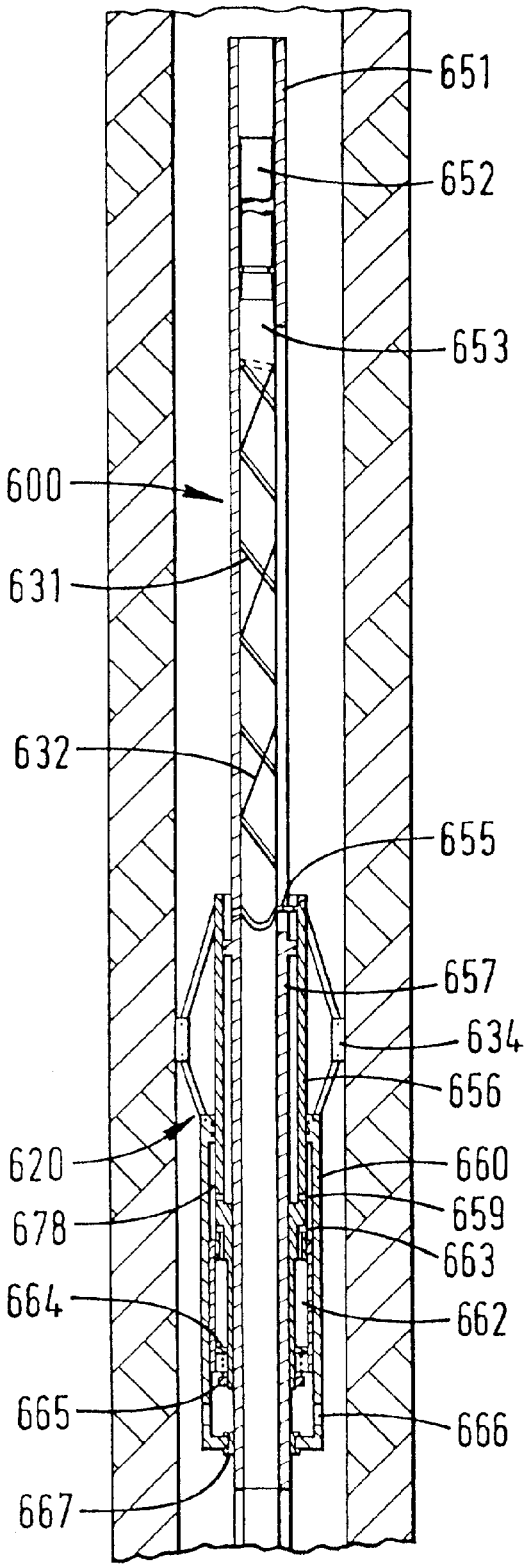
FIG. 2A is a side view in cross-section of a wellbore tractor system according to the present invention.
Figure 2A:
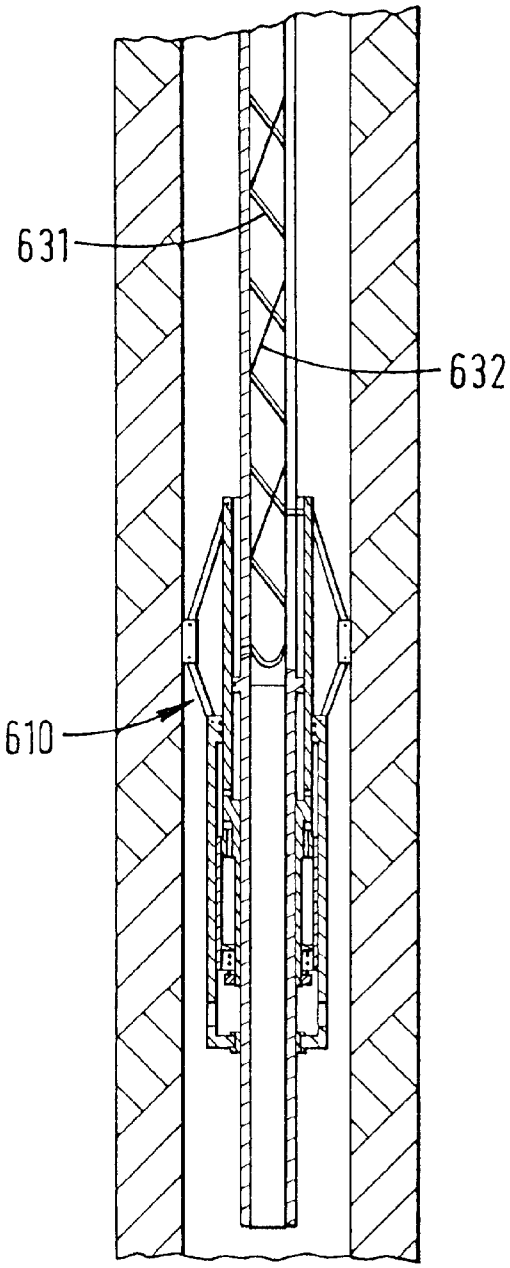
Figure 2B:
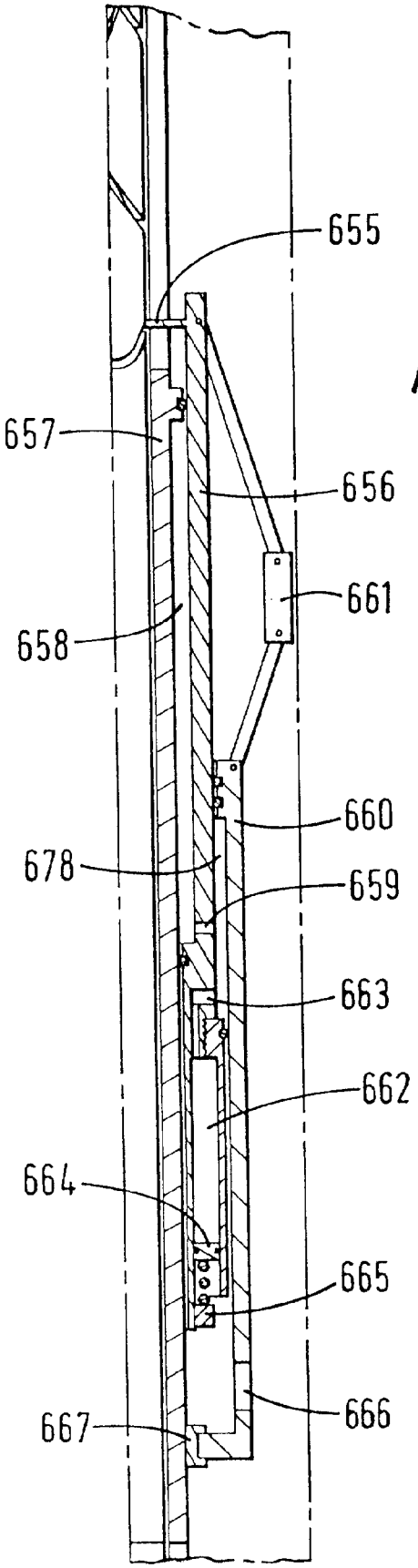
FIG. 2B is an enlarged view of part of the system of FIG. 2A.

As shown in FIGS. 1A–1C2, a wellbore tractor system 100 according to the present invention has two tractor units, an upper unit 150 and a lower unit 160. The upper half 150 has a mud motor 102 in fluid communication with a wellbore tubing string 101 such as is typically interconnected with a wellbore mud motor. An inflatable hydraulic fluid reservoir bladder 103 is disposed in a chamber 151 in a housing 152. The mud motor 102 is powered by pressurized fluid selectively supplied through the tubing 101, into the housing 152, to the mud motor 102. Fluid exhausts from the mud motor 106 through ports 106 which are in fluid communication with an internal bore 118 through the system 100.

The mud motor 102 powers a pump 107 which pumps fluid under pressure from the bladder 103 in a line 105 and then in a line 128 through an annulus 108 to the tractor units 150 and 160. The annulus 108 is between an inner housing 110 which is secured to a middle housing 109, both of which are secured to the housing 152.

Figure 1B:
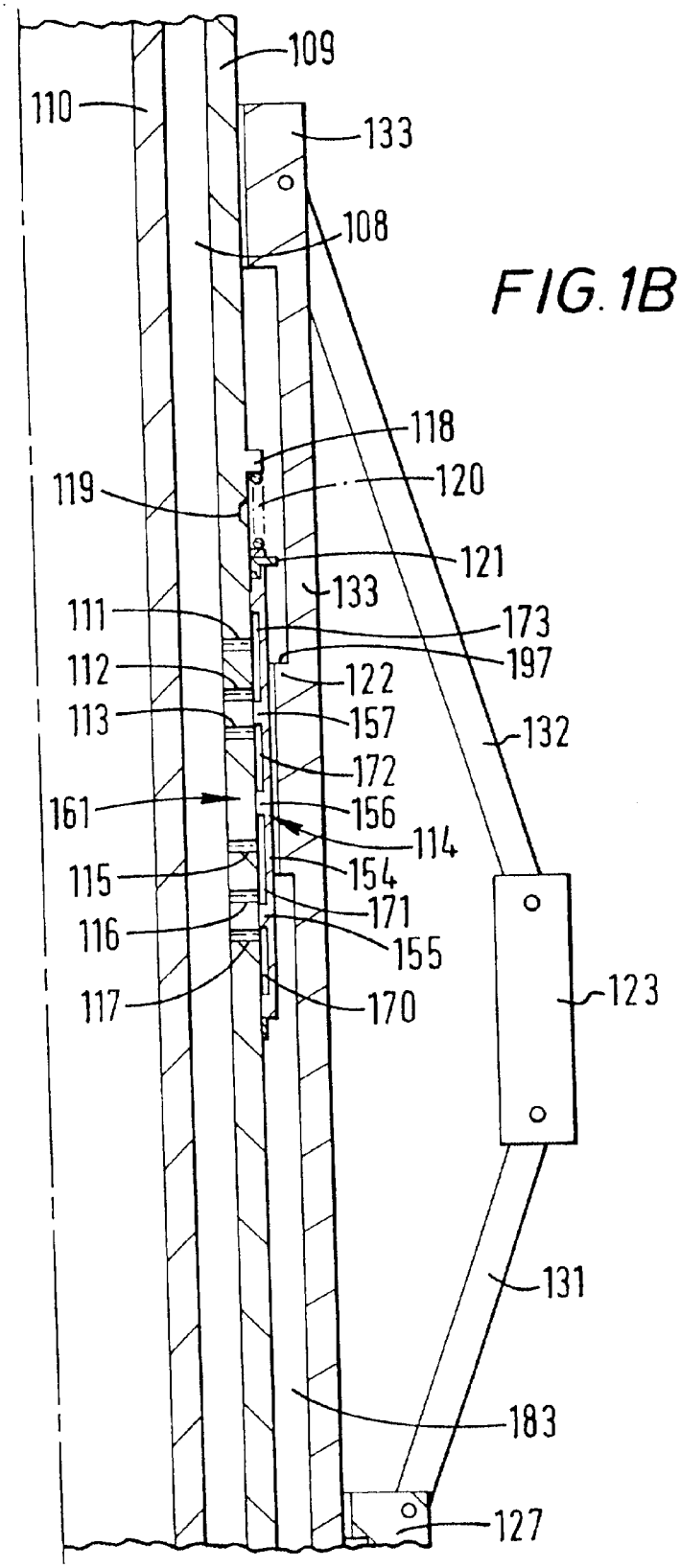
FIG. 1B is an enlargement of a portion of the system of FIG. 1A.

The tractor units advance the middle housing 109 (and hence the tubing string 101) by pushing against shoulders projecting outwardly from the middle housing 109, an upper shoulder 189 and a lower shoulder 190. Hydraulic circuit piping and other elements interconnecting the pump 107 and various tractor unit control valves and ports are located within the annulus 108. Via a port 104 the pressure of fluid in an annulus 153 between an inner wall 134 of a wellbore 130 and an outer wall of the mud motor housing 152 is applied to the bladder 103. In the hydraulic circuit shown in FIGS. 1B and 1C pump 107 pumps fluid under pressure to a control valve 161 and to control valves 125 and 126. The control valve 161 controls the lower unit 160 and the control valves 125 and 126 control the upper unit 150.

A valve member 114 disposed around the middle housing 109 has a body 154 with ribs 155, 156, 157 that define a plurality of fluid communication chambers 170, 171, 172, and 173. A sleeve 133 disposed around the middle housing 109 is movable to move the valve member 114 so that various ports are in fluid communication via the communication chambers 170–173. These ports include ports 111, 112, 113, 115, 116, and 117.

Pivotably secured to the outer housing 127 is a first slip arm 131 which is also pivotably secured at its other end to a slip 123. A second slip arm 132 has a first end pivotably secured to the slip 123 and a second end pivotably secured to the sleeve 133. As the outer housing 127 moves up with respect to the sleeve 133 and with respect to the middle housing 109, the slip arms 131, 132 pivot to move the slip 123 of the upper unit 150 outwardly to contact and engage the inner wall 134 of a wellbore 130.

The upper unit 150 has an outer housing 127 which is movable with respect to the valve member 114 and the middle housing 109. The lower unit 160 has a similar outer housing 147, slip arms 148 and 149, and slip elements 146 which operate in a similar fashion.

The sleeve 133 has an activating ring 122 that contacts and moves a pivot arm 121 of the valve member 114, thereby moving the valve member 114. A spring 120 biases the pivot arm 121 and hence the valve member 114 initially downwardly. An abutment surface on the interior of the sleeve 133 is movable to contact valve stems 144 and 178 of the control valves 125, 126 respectively to selectively move and operate these control valves. O-rings 124 in corresponding recesses seal interfaces between various elements.

The control valve 125 is disposed in a chamber in the upper shoulder 189 of the middle housing 109 and has a valve member 177 which is connected to the valve stem 178 and is movable to permit fluid flow between ports 174 and 175 or between ports 175 and 176. The control valve 125 is a return valve that controls fluid flow for a retract chamber 182 of the upper unit 150.

The port 174 is in fluid communication with a flow line 192. The port 175 is in fluid communication with a flow line 139 which is in fluid communication with a power chamber 183. The port 176 is in fluid communication with a flow line 191 which is connected to a retract chamber 182.

The control valve 126 is diametrically opposed to the control valve 125 and works simultaneously in tandem with it. The control valve 126 is disposed in a chamber in the lower shoulder 190 of the middle housing 109 and has a valve member 140 which is connected to the valve stem 144 and is movable to permit fluid flow between ports 141 and 142 or between ports 142 and 143. The control valve 126 controls the flow of fluid to the power chamber 183 for the upper unit 150. The port 143 is in fluid communication with a flow line 171 which is connected to the retract chamber 182. The port 142 can be in fluid communication with the flow line 141 or 143. The port 141 is in fluid communication with a flow line 170 which is connected to the power chamber 183.

In a typical cycle of operation of the system 100, the system 100 connected to a tubular string 101 is introduced into the wellbore 130 and located at a desired location therein, e.g. by the force of gravity on the system 100. At that location motive fluid under pressure is supplied down through the tubular string 101 to the mud motor 102. The mud motor 102 drives the pump 107 which in turn pumps fluid under pressure from the bladder 103, through the line 119, into the annular space 108 for provision to the various valves that control the tractor units 150 and 160. The pump 107 pumps hydraulic fluid under pressure into a line 199, to a line 138, to the port 112. With the valve member 114 in the position shown in FIG. 1C1, fluid flows from the port 112, into the chamber 173, to the port 111, to a line 194, and down to the lower unit 160. The fluid flows into a power chamber 181 of the lower unit 160 and simultaneously moves the sleeve 133 upwardly and the outer housing 147 upwardly. The fluid flows from the chamber 181, through a port 187, into a chamber 186. (The slip 146 of the lower unit is already set at this point in the cycle.)

The system 100/tubing 101 is moving downwardly in the wellbore at this point in the cycle.

As the sleeve 133 moves upwardly an upper shoulder 197 of the activating ring 122 contacts and then pushes on the pivot arm 121, compressing the spring 120, and moving the valve member 114 upwardly (as viewed in FIG. 1C1). Eventually, the pivot arm 121 is moved to a position adjacent a notch 119 and the pivot arm 121, which is pivotably attached to an upper end of the body 154 of the valve member 114, pivots into the notch 119 freeing the sleeve 133 for further upward movement.

As the pivot arm 121 is moving toward the notch 119, the valve member 114 is moving upwardly and fluid flow is stopped between the ports 111 and 112, cutting off the flow of fluid to the power chamber 181 of the lower unit 160. At this point the power stroke of the lower unit ceases. While the activating ring 122 moves upwardly over the pivot arm 121 in the notch 119, the valve member 114 is prevented from moving downwardly and fluid flows through the port 112, through a chamber 172, through a port 113, to a line 195, to a retract chamber 180 of the lower unit 160 and retraction commences. A portion of the fluid from the port 113 flows into a line 145 in fluid communication with the port 115. This fluid portion flows from the port 115 to the sump 103 through a line 193.

The size, length, disposition, and configuration of the activating ring 122 determine the length of time that fluid flows to the power chamber 181 of the lower unit 160, thus controlling the length and timing of the power stroke of the lower unit 160. During this time period there is no fluid communication between the ports 111 and 112. Once the activating ring 122 has moved upwardly beyond the notch 119, the pivot arm 121 is again freed and is pivoted outwardly by the spring 120 and the valve member 114 is freed to move downwardly, again positioning the chamber 173 so that fluid communication between the ports 111 and 112 occurs. As the retract chamber 180 begins to fill with fluid under pressure and move the sleeve 133 downwardly, fluid in the power chamber 181 moves out through the line 194, to a line 137, to the port 117, to the chamber 170, to the port 116, to the line 193, to the line 136, and back to the bladder 103.

At this point in the cycle (shown in FIGS. 1C1, 1C2) fluid under pressure is simultaneously powering the lower unit 160 and the upper unit 150; the activating ring 122 is moving toward the pivot arm 121; and the tubular string 101 is being moved downwardly in the wellbore 130. The force of fluid in the lower power chamber 181 acts on the shoulder 190 to move the middle housing 109 (and thus the tubular string 101) downwardly; as does the force of fluid in the upper power chamber 183 acting on the upper shoulder 189.

While the power stroke of the upper unit 150 is still ongoing (due to the continuing provision of fluid under pressure to the upper power chamber 183 as described below) the control valve 161 with its valve member 114 is activated so that fluid flow to the power chamber 181 of the lower unit 160 ceases and fluid flow to the retract chamber 180 of the lower unit 160 commences, thus switching the lower unit 160 from a power stroke to a retract stroke in which the slips 146 are disengaged and the middle housing 109 is free to move downwardly with the lower unit 160. As soon as the activating ring 122 passes the notch 119, the pivot arm 121 pivots outwardly freeing the valve member 114, and the valve member 114 moves to again provide for the intercommunication of ports 111, fluid flows into the lower power chamber 181 and a new power stroke of the lower unit 160 commences. At every moment in the cycle power is provided to move the tubular string 101 by the upper unit 150, the lower unit 160, or both.

The control valves 125 and 126 control the flow of fluid under pressure to and from the upper unit 150. When the sleeve 133 has moved upwardly to a sufficient extent, the abutment surface 158 simultaneously contacts the valve stems 144 and 178. Subsequent movement of the valve members 140 and 177 results in fluid flowing away from the upper power chamber 183 and into the upper retract chamber 182, shifting the upper unit from a power stroke to a slip retraction stroke, permitting the middle housing 109 and tubular string 101 to move downwardly with the upper unit 150 while the lower unit 160 has its slips set and is in its power stroke.

During a power stroke of the upper unit 150, fluid under pressure flows from the line 199, to the line 139, to the port 175, through the chamber in which the valve member 177 is movably disposed, to the port 174, to the upper power chamber 183. Upon shifting of the valves 125 and 126 (at the end of the power stroke of the upper unit 150) by the upward movement of the sleeve 133, fluid communication between the ports 174 and 175 is prevented by the valve member 177 and fluid flows from the line 139, to the port 175, to the port 176, to the line 191, to the upper retract chamber 182. Fluid under pressure in the upper retract chamber 182 pushes down on the sleeve 133 retracting the slips 123 and disengaging the upper unit 150 from the wellbore wall 134.

When the retract stroke of the upper unit 150 begins, the power stroke of the lower unit 160 is already in progress (due to the timed and controlled introduction of fluid into the lower power chamber 181 as described above). When the retract stroke of the lower power unit 160 begins, the power stroke of the upper unit 150 is already in progress. Thus power is provided for the continuous movement of the tubular string 101.

The valve member 140 of the control valve 160 is initially in position as shown in FIGS. 1C1, 1C2 so that fluid communication is established between the ports 141 and 142, and thus between the power chamber 183, a line 170, and a line 135 which is interconnected via a line 136 with the bladder 103. Upon shifting of the valve member 140, fluid no longer flows between the ports 141 and 142 and fluid therefore no longer flows from the power chamber 183 through the lines 170, 135, and 136 to the bladder 103. Instead, fluid communication is established between the ports 142 and 143, thus allowing fluid to flow from the lines 135 and 171 to the upper retract chamber 182 to effect disengagement and retraction of the slips 123 and freeing of the upper unit 150 for movement with the middle housing 109. Simultaneously, fluid flows back to the bladder 103 from the upper retract chamber 182, through the line 191, to the port 176, to the port 175, to the line 139, to the line 138, through the valve 161, back to the bladder 103.

When the sleeve 133 moves back downwardly, the valve stems 144 and 178 also move down, shifting the valve members 140 and 177 respectively back to their initial positions (e.g. as in FIGS. 1C1, 1C2) and a power stroke of the upper unit 150 commences.

A payload 158 (e.g. but not limited to logging tools, perforating guns, sand clean-out equipment or any item run on the end of coiled tubing or on the end of a wireline) is connected to the bottom of the middle housing 109.

Figure 4:
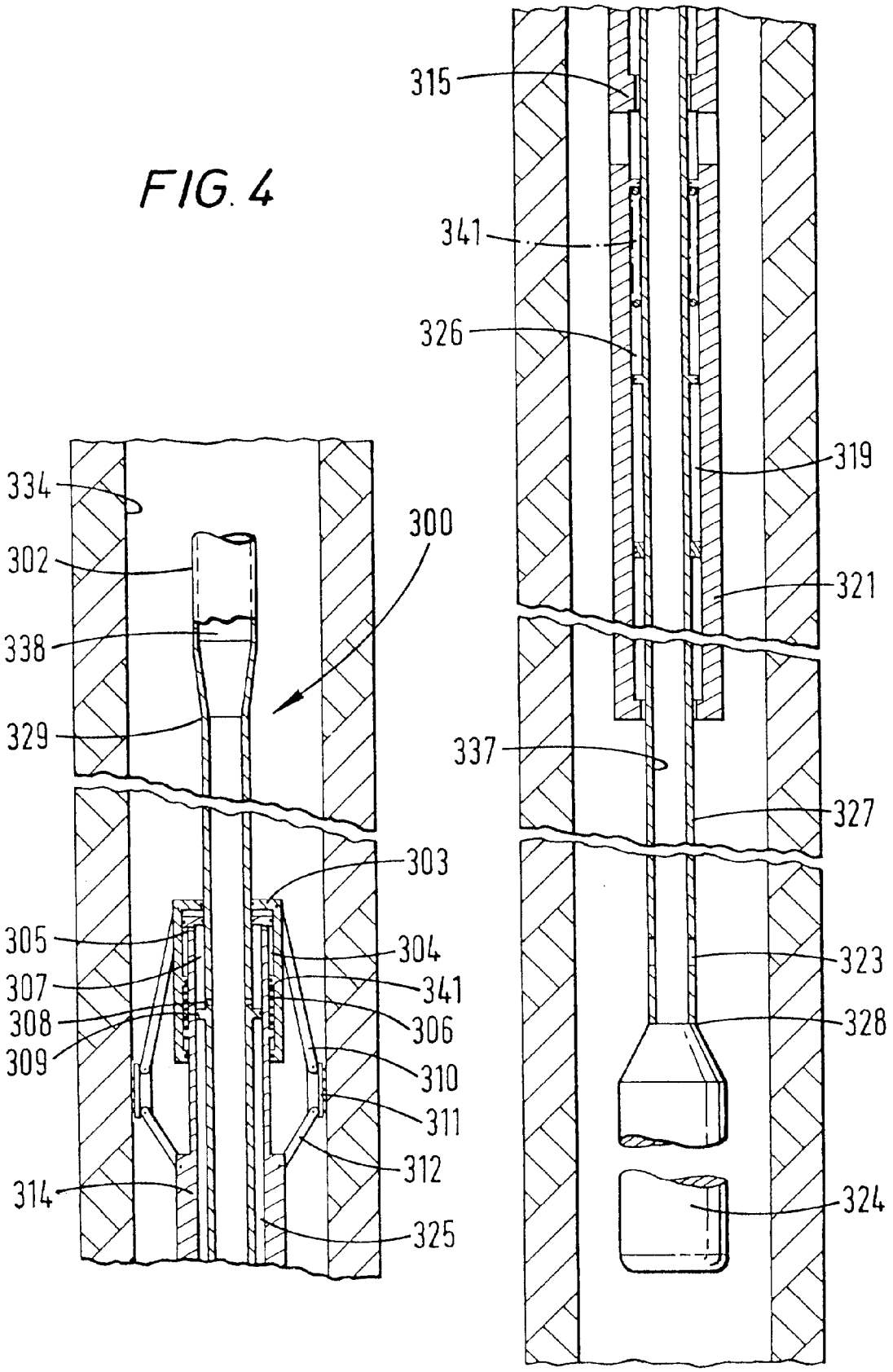
FIG. 4 is a side view in cross-section of a wellbore tractor system according to the present invention.

A wellbore tractor system 300 according to the present invention as shown in FIG. 4 is used to move a tubular string 302. Of course this system may be used to move pipe, cable, casing, or coiled tubing. A payload 324 is connected to a lower end 328 of a hollow mandrel 327. An upper end 329 of the hollow mandrel 327 is connected to the tubing 302 and a flow bore 337 of the hollow mandrel 327 is in fluid communication with a flow bore 338 through the tubing 302.

Fluid at relatively high pressure is pumped down the tubing 302 into the mandrel 327; e.g. a surface mud pump pumps high pressure liquid which enters the mandrel 327 and exits it through exhaust ports 323 near the lower end 328. Preferably the liquid is at a sufficiently high pressure that the fluid pressure within the mandrel 327 is higher than the pressure of fluid in a wellbore 330 through which the system 300 extends.

The high pressure fluid enters an expansion chamber 307 through a port 308. The expansion chamber 307 is defined by an exterior surface of the mandrel 327, an interior surface of a slip 20 housing 314, and a mandrel seal 309. The fluid also enters a slip set chamber 304 through a port 305 which is in fluid communication with the expansion chamber 307. The slip set chamber 304 is defined by an outer surface of the slip housing 314, and an inner surface of an upper housing 303.

The increased pressure in the slip set chamber 304 moves the upper housing 303 against a spring 306 and toward a bottom housing 221. The spring 306 initially abuts an inner shoulder 335 on the upper housing 303 and a lower outer shoulder 336 of the slip set housing 314 and urges these two members apart. This movement of the upper housing 303 (down in a vertical wellbore, laterally in a horizontal wellbore, at a diagonal in a non-vertical non-horizontal wellbore) toward the lower housing 321 results in the setting of slips 311 against an inner wall 334 of the wellbore 330, setting the slips and centering the system 300 in the wellbore 330.

Each slip 311 has a first slip end pivotably connected to a lower slip arm 312 which has a lower end pivotably connected to the slip housing 314 and a second slip end pivotably connected to an upper slip arm 310 which has an upper end pivotably connected to the upper housing 303. Setting of the slips 311 secures the upper housing 303 and the bottom housing 321 in place in the wellbore 330.

The high pressure fluid pushes against the seal 309, expanding the expansion chamber 307 pushing the mandrel 327 (downwardly in FIG. 4) which results in the movement of the tubing 302. This also decreases the volume of a hydrostatic chamber 325 while increasing the volume of a sub-hydrostatic chamber 326. The hydrostatic chamber 325 is defined by an outer surface of the mandrel 327 and an inner surface of sliphousing 314. The subhydrostatic chamber 326 is similarly defined. Movement of the mandrel 327 ceases when the seal 309 abuts a stop 315 on the inner surface of the slip housing 314. When the tubing string ceases its motion, the pumping of fluid into the tubing is stopped and then the pressure in the expansion chamber 307 and in the slip set chamber 304 equalize with the pressure in the wellbore 330. This allows the spring 306 to move the upper housing 303 away from the bottom housing 321 which results in the disengagement of the slips 311 from the wall 334 of the wellbore 330.

Fluid pressure in the sub-hydrostatic chamber 326 is significantly less than (e.g., but not limited to, atmospheric vs. 5000 to 6000 p.s.i.) the hydrostatic pressure of fluid in the wellbore 330, in the expansion and slip set chambers, and in a buffer chamber 319 below the sub-hydrostatic chamber 326. This pressure differential causes the sub-hydrostatic chamber 326 to contract along with the expansion chamber 307 as the hydrostatic chamber 325 expands. A spring 341 acts to dissipate the force of undesired impacts on the system and/or on the payload 324. As a result of these chamber expansions and contractions, the upper housing 303 and the bottom housing 321 (with the slips disengaged from the wellbore) move (down in FIG. 4) with respect to the mandrel 327 until the spring 341 is completely compressed.

When the system 300 has moved, the surface mud pump is again activated to set the slips and move the mandrel to advance the tubing 302. A system such as the system 300 may be activated and deactivated by an operator at the surface cycling a pump to pump fluid down to the system. In one aspect the system will be on for intervals of about 30 seconds and off for intervals of about 30 seconds. It is within the scope of this invention, in certain embodiments, to cycle the system at intervals of as much as 3 minutes or as little as 30 seconds. It is within the scope of this invention to use two or more systems (e.g. like the systems 100, 400) interconnected together so that the power strokes of the systems overlap providing continuous motion.

Figure 5:
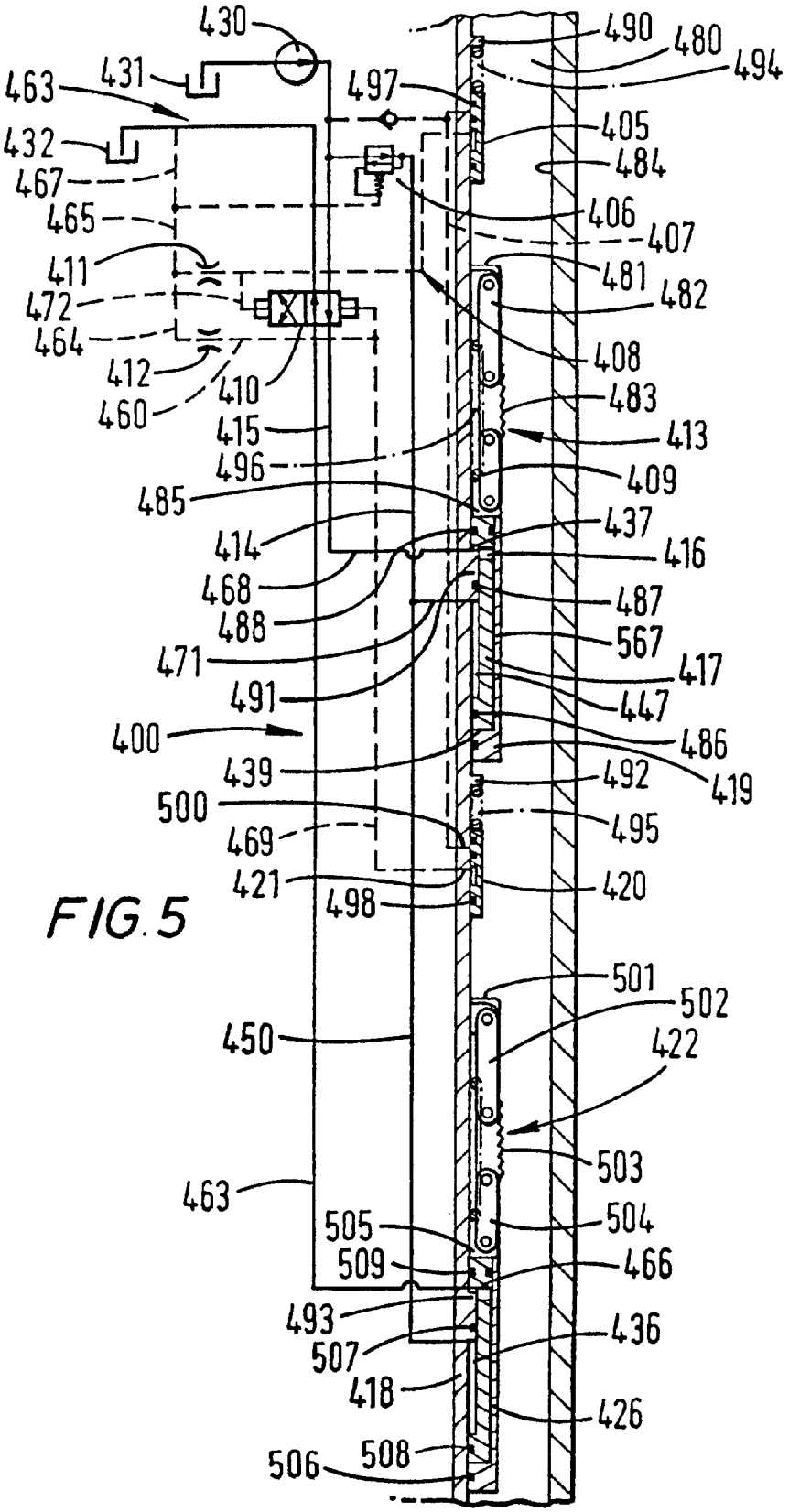
FIG. 5 is a side view in cross-section of a wellbore tractor system according to the present invention.

FIG. 5 shows a wellbore tractor system 400 which provides near-continuous motion to move an item through a wellbore 480.

The system 400 has a mandrel 418 with two tractor elements, a lower or front tractor unit 422 and an upper or rear tractor unit 413. The mandrel 418 is connected at one end to an item or string to be moved through a wellbore or tubular.

The system 400 has two hydraulic circuits, a power-retract circuit for the two tractor units (including lines 463, 468 and 418) and a control circuit (including lines 464, 465, 467, 472, 470, 471, 407, 460 and 469 and valves 405, 406, 410 and 420).

Fluid for controlling the upper tractor unit flows to and from a rear pilot control valve 405; and fluid for controlling the lower tractor unit flows to and from a front pilot control valve 420. A pump 430 for the system may be driven by a downhole motor or it may be electrically powered and run on a cable. The pump 430 pumps fluid to and from a sump 431 and a sump 432.

The upper tractor unit 413 has an arm mount 481 to which is pivotably connected an end of a first arm 482. The other end of the first arm 482 is pivotably connected to an end gripper 483. The other end of the gripper 483 is pivotably connected to an arm mount 485. A grip set piston 419 coacts with the arm mount 481. A seal 486 (e.g. an O-ring seal) seals the mandrel/grip set piston interface at one end of the grip set piston 419. The other end of the grip set piston 419 wraps over the outer end of the arm mount 481. An operating piston 417 is movably disposed between the grip set piston 419 and the mandrel 418. A port 416 is located between an end of the operating piston 417 and the arm mount 485. A seal 487 seals the operating piston/mandrel interfaces. A seal 488 seals the arm mount/mandrel interface and the arm mount/grip set piston interface. The mandrel has exterior shoulders 409, 491, and 493.

A spring 494 urges a rear pilot control valve 405 away from the shoulder 490. A spring 495 urges a front pilot control valve 420 away from the shoulder 492. A spring 496 urges the arm mounts 481 and 85 apart. Seals 497 seal the rear-pilot-valve/mandrel interface. Seals 498 seal the front-pilot-valve/mandrel interface.

The lower tractor unit 422 has an arm mount 501 to which is pivotably secured one end of an arm 502. The other end of the arm 502 is pivotably secured to one end of a gripper 503. The other end of the gripper 503 is pivotably secured to one end of an arm 504. The other end of the arm 504 is pivotably secured to an arm mount 505. One end of a grip set piston 424 wraps over the arm mount 505 and the other end of the grip set piston moves along the mandrel 418. A seal 506 seals the grip-set-piston/mandrel interface at one end of the grip set piston 424. An operating piston 426 is movably disposed between the grip set piston 424 and the mandrel 418. A seal 507 seals the shoulder 493/operating-piston interface. A seal 508 seals the operating-piston/mandrel interface. A seal 509 seals the arm-mount/mandrel interface and the arm-mount/grip-set-piston interface.

Figure 6A:
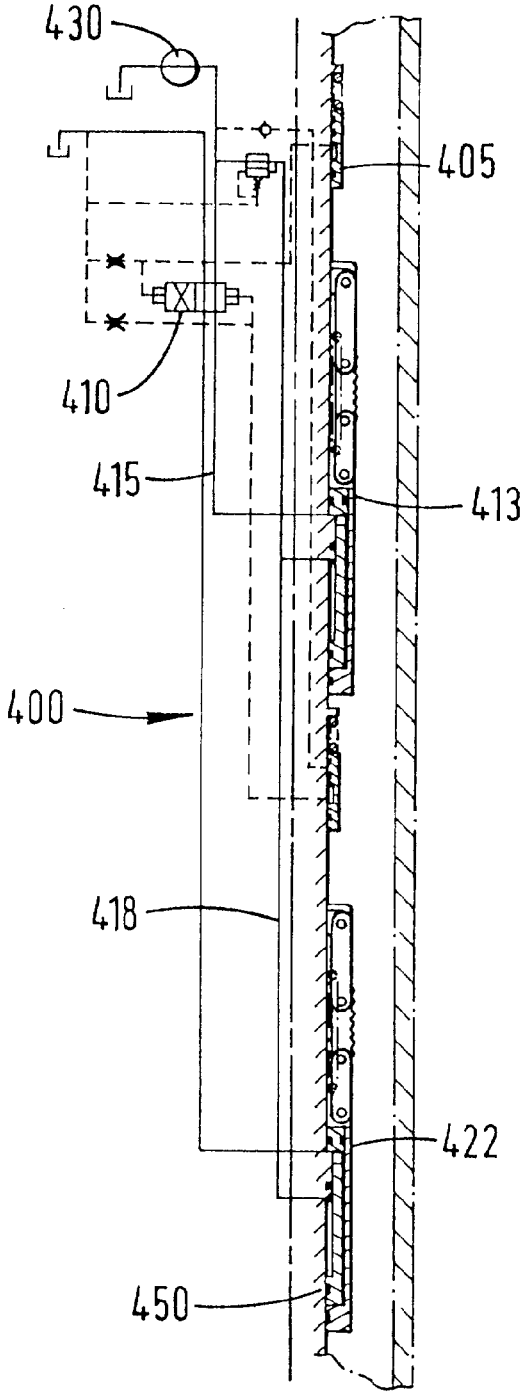
FIGS. 6A–6D illustrate a sequence of operation of the system of FIG. 2.
Figure 6B:
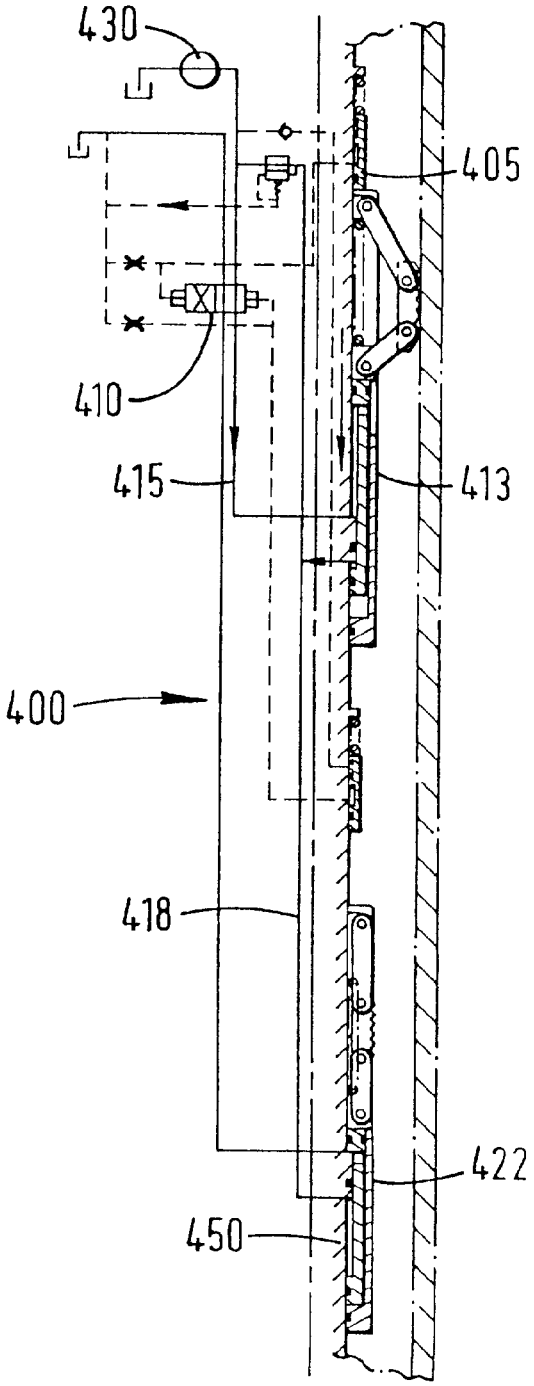

As shown in FIGS. 5 and 6B, fluid under pressure through a line 414 enters an upper power chamber 447. A portion of this fluid passes through a port 416, between the operating piston 417 and the grip set piston 419, to a chamber 439. As the chamber 439 expands, the upper end of the grip set piston 419 pulls (to the right in FIG. 5) the arm mount 481 and related apparatus so that the slips of the lower tractor unit 413 are moved out to engage the wellbore wall. Simultaneously fluid under pressure in the upper power chamber 437 acts on a shoulder 491, driving the system 400 (to the right in FIG. 5) and the item or string attached to it into the wellbore. Simultaneously fluid under pressure in a line 418 from a valve 406 enters a chamber 436 to retract the slips of the lower tractor unit 422. In FIG. 6B the upper tractor unit's power stroke is nearly finished and the retract stroke of the lower tractor unit is complete.

Then a valve 410 shifts (see FIG. 6C), fluid under pressure is directed through a line 468 to a retract chamber 566 of the upper tractor unit 413 which begins filling and retraction of the slips of the upper tractor unit 413 commences, the chamber 466 of the lower tractor unit 422 begins filling, and the power stroke of the lower tractor unit 422 commences. At this time the upper tractor unit's power chamber 437 and the lower tractor unit's retract chamber 436 are in fluid communication with a sump or reservoir 432; fluid is coming back to the sump 432 (indicated in two locations schematically, but only one sump) from the upper tractor unit's retract chamber 566 and from the lower tractor unit's power chamber 466 through lines 418 and 471.

In FIG. 6B so that fluid pressure in the power chamber 447 of the upper tractor unit is greater than that in the retract chamber 436 of the lower tractor unit, i.e., so the power chamber receives fluid at a sufficiently high pressure to move the mandrel 418, a pressure relief valve 406 controls pressure in the various lines and insures that pressure to the retract chamber is sufficient for retraction but not greater than the pressure to the power chamber of the upper tractor unit.

Preferably the dwell time between power strokes of the two tractor units, the time required for the valve 410 to switch power fluid from one tractor's power chamber to the other chamber's power chamber, is at most 5% of the time for a cycle of the system, more preferably at most 2%, and most preferably 1%.

As the system 400 moves the mandrel 418 (to the right in FIG. 6B), the grip set piston 419 compresses the spring 494 and moves the rear pilot valve 405 so that fluid communication commences between lines 571 and 408. This permits fluid to flow through the line 472 to the valve 410 to shift thereby shifting the upper tractor unit from a power stroke to a retract stroke, and shifting the lower tractor unit from a retract stroke to a power stroke.

Figure 6C:
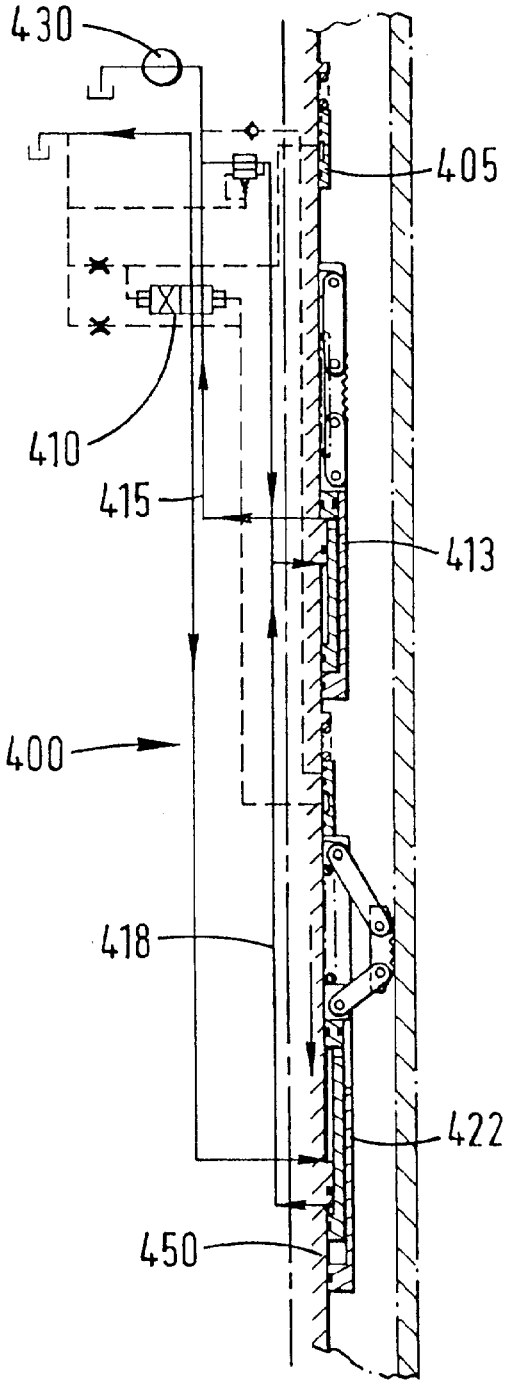
Figure 6D:
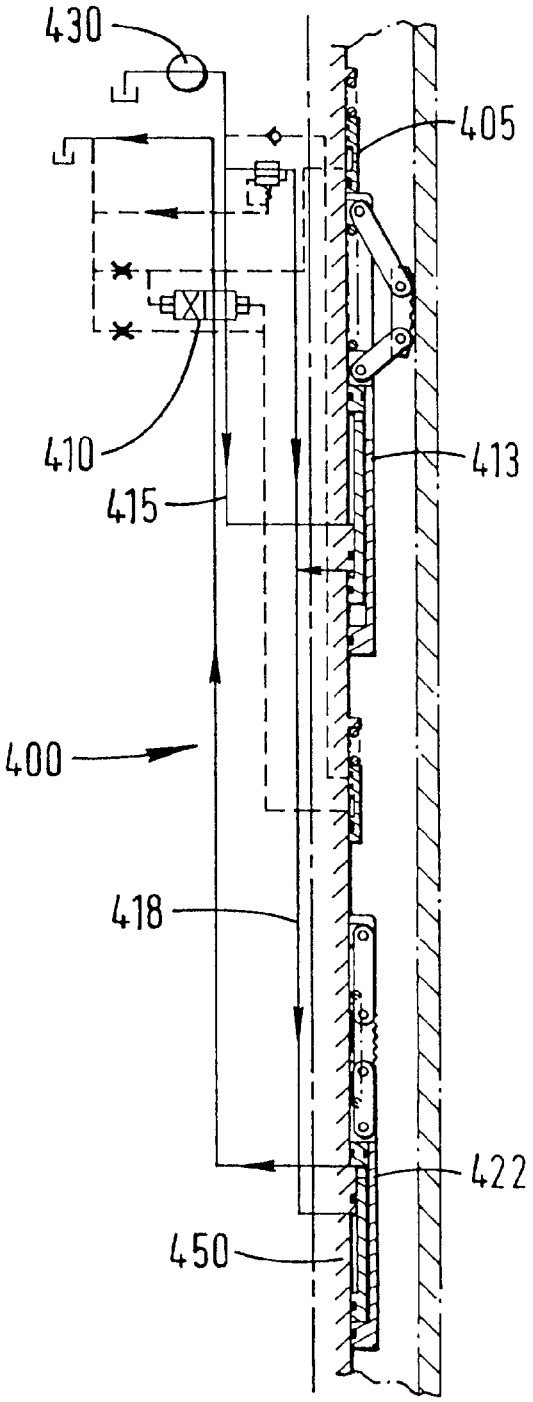

FIGS. 6A–6D show a sequence of operation of the system 400. FIG. 6A is a duplicate of FIG. 5 and shows an initial position of the system for running it into a wellbore or tubular. In FIG. 6B the upper tractor unit 413 is in its power stroke and the lower tractor unit 422 is in its retract stroke. In FIG. 6C the upper tractor unit 413 is in its retract stroke and the power stroke of the lower tractor unit 422 has begun. FIG. 6D is like FIG. 6B, but in FIG. 6D the upper unit has just reached the end of a power stroke and is switching to a retract stroke, while the lower unit has just ended its retract stroke and is starting to set its slips. Hydraulic fluid pressure in all chambers of the tractor elements is equalized (to stop the tractor system with the slips on both units retracted, e.g. in order to remove the tractor system from the wellbore) with the pressure of fluid in the wellbore 480 with the bleed valves 411 and 412 through which fluid bleeds back to the sump 432. Arrows on flow lines indicate flow direction.

In FIG. 6B the upper tractor unit 413 has been activated so that its gripper 483 is moved to engage the wellbore wall 484. The pump 430 provides hydraulic fluid under pressure to the power chamber 437 and the rear operating piston 417 through a line 415. The pilot operated directional valve 410 controls flow through the line 415. The valve 410 is detented to provide a toggle action between two control positions and, in the absence of pilot pressure through a line 472 or a line 469 remains in the last position to which it is piloted. For start up, the valve 410 can be in either position since fluid will be directed to a power piston of one of the tractor units, and either tractor unit may be the first one activated.

Fluid under pressure in the power chamber 437 is also transmitted via the port 416 to a grip set chamber 417 (an annular area between the grip set piston and a shuttle sleeve 567).

Fluid pressure in the power chamber 437 relative to the fluid pressure in the retract chamber 447 forces the mandrel 418 to traverse down the borehole (see FIG. 6B). Fluid exhausted from the retract chamber 447 is exhausted through a reducing/relieving valve 406 back to the sump 432.

Near the end of the stroke, the upper tractor unit 413 opens the pilot control valve 405 and allows pilot pressure to enter a rear pilot control port 408 of the valve 410. Pilot pressure shifts the directional control valve 410 to the other position. A bleed valve 411 provides sufficient flow restriction in the pilot control port to allow the valve 410 to shift.

The pump pressure output is then diverted to the power chamber 466 of the lower tractor unit causing it to grip and push in the same manner as that of the upper tractor unit (See FIG. 6C). The valve 410 diverts fluid in the power chamber 437 of the upper tractor unit 413 to the sump 431 at relatively low pressure. Since the pressure inside the retract chamber 447 is higher than the pressure inside the power chamber 437, this causes the upper tractor unit to begin to retract to the initial state (FIG. 6A).

The pressure in a grip-set chamber 439 of the upper tractor unit 413 is equalized to the pressure in the power chamber 437. Therefore, when the pressure inside the power chamber 437 is diverted to (low) sump pressure, a spring 409 forces the fluid out of the grip set chamber 439 back to the sump 432 and allows the grippers to collapse onto the mandrel 418. As the upper tractor unit 413 reverses its direction relative to the mandrel 418, a spring 494 closes the rear pilot control valve 405 shutting off pilot pressure in lines 407 and 472 to the pilot port of the valve 410. The remaining pilot pressure in the line 470 is bled off through a bleed valve 411 back to the tank 432 through the lines 465 and 467.

The lower tractor unit 422 moves the mandrel 418 due to fluid filling its power chamber 466. Meanwhile, fluid from its retract chamber 436 is being displaced by the movement of the tractor unit. This fluid is then forced into the retract chamber 447 of the upper tractor unit 413, allowing it to retract. In addition, the valve 406, a reducing/relieving valve, diverts a pre-set amount of fluid flow from the pump 430 into a regenerative line 414 through the valve 406 at a preset pressure. This fluid flow when combined with the fluid flow displaced from the front retract chamber 436 is forced into the retract chamber 447 of the upper tractor unit 413. Since the volume displaced into the upper tractor retract chamber 447 is greater than the volume displaced from the lower retract chamber 436, the upper tractor unit 413 is therefore retracted faster than the lower tractor unit completes its stroke. This means that the upper tractor unit 413 is ensured complete stroke, does not "short stroke", and is ready to go as soon as the lower tractor unit 422 completes its stroke so that there is near-continuous motion of the system 400.

Once the upper tractor unit 413 is completely retracted, the lower tractor unit 422 continues its traversing of the mandrel 418. Excess fluid displaced from the retract chamber 436 of the lower tractor unit 422 is dumped to the sump 431 from the reducing/relieving valve 406.

As the lower tractor unit 422 completes its stroke, it opens a front control valve 420 and allows pilot pressure into the other side of the valve 410 through pilot line 421, causing the valve 410 to shift to its original position. The pump 436 output pressure is then diverted to the power chamber 437 of the upper tractor unit 413 (see FIG. 6D) enabling it to grip and traverse in the same manner as the lower tractor unit 422.

This cyclical motion is repeated as long as the pump 430 is producing fluid under pressure, causing the system to "walk" through or down the borehole. When the pump 436 is stopped, the power lines 468 and 463 to both power chambers bleed back to sump pressure. Spring loading of the grippers causes them to collapse back to the initial state, allowing the system to be retrieved from the hole.

FIGS. 2 and 3A–3E show a system 600 according to the present invention. In certain aspects such a system operates in either open-hole or cased-hole wells that are vertical, inclined, or horizontal. The system can be used with a tubular string, a drill pipe string, a tubing string, wireline, or coiled tubing.

The system 600 has a lower tractor unit 610, an upper tractor unit 620, and a central mandrel 653. The central mandrel 653 has a first thread 631, the power thread, at one pitch (e.g. about two complete threads per foot) and a second thread 632, the retract thread, at another pitch (e.g. about one complete thread per foot). A downhole motor 652 is connected to the central mandrel 653 and is selectively powered from the surface to rotate the central mandrel 653. There are two spaced-apart thread sets 631, 632.

The system 600 provides continuous motion since, due to the difference in pitch of the first thread 631 and the second thread 632, the power stroke of each tractor unit during which the system moves into the wellbore is longer than the return stroke. The return stroke is the part of the power cycle of a tractor unit in which it is not advancing the system in the wellbore, but is being moved with the system while the other tractor unit is anchored against the wellbore's interior.

In a typical cycle of operation of the system 600, motive fluid is pumped down tubing 651 from the surface to power the mud motor 652. This rotates the mud motor which in turn rotates the central mandrel 653. A following pin 655 secured to the middle housing 656 engages and rides in the thread (which includes the power thread going in one direction and the retract thread going in the other direction thereby moving a middle housing 656 (upwards in FIG. 2) in relation to an inner housing 657. This movement decreases the size of a power chamber 658 and fluid therein is compressed. This fluid is transmitted through a port 659 to a slip set chamber 678. Introduction of the fluid into the slip set chamber 678 expands the chamber resulting in the movement of an outer housing 560 (upwards in FIG. 2) over the middle housing 656, thereby setting slips 634.

As the slip setting continues, excess fluid in the slip set chamber 678 flows through a pressure regulator valve port 663 into a reservoir chamber 662, thus maintaining a constant pressure, e.g. slightly above the hydrostatic pressure of fluid in the wellbore annulus, in the slip set chamber 678 and keeping the slips 634 set. A compensating piston 664 maintains a constant hydrostatic pressure (pressure level in the annulus between the system's exterior and the wellbore's interior) in the reservoir chamber 662. A retaining collar 665 prevents the compensating piston 664 from moving past the lower end of the middle housing 656 and hydrostatic ports 636 allow hydrostatic pressure from the wellbore to act below the compensating piston 664.

The following pin 655 in the power thread 631 also pulls the inner housing 657 through the middle housing 656 and through the outer housing 660 through a centralizer 667, thus moving the tubing 651 into the wellbore.

At the end of the power stroke the following pin 655 reaches the end of the power thread 631, and shifts into the retract thread 632 and reverses direction beginning a retract cycle. During the retract cycle of one tractor unit, the fluid pressure in all the chambers of the unit returns to hydrostatic pressure via ports 659, 663 and 666 allowing disengagement and unsetting of the slips. With the slips of the upper tractor unit disengaged, the middle housing 656 and outer housing 660 are pulled downward relative to the inner housing 657 by the lower tractor unit. At the end of the retract cycle of the upper unit, the following pin 655 again enters the power thread and reverses to commence another power stroke of the upper unit.

Since both the upper tractor unit 620 and the lower tractor unit 610 operate on the central mandrel 653 with its thread including the interconnected power thread and retract thread, and each unit's power stroke is longer than each unit's retract stroke, the power stroke's will always overlap in time and the system 600 will provide continuous motion and it is always the case that when either unit is in a retract stroke the other unit is in part of its power stroke.

Figures 3A, 3B, 3C:
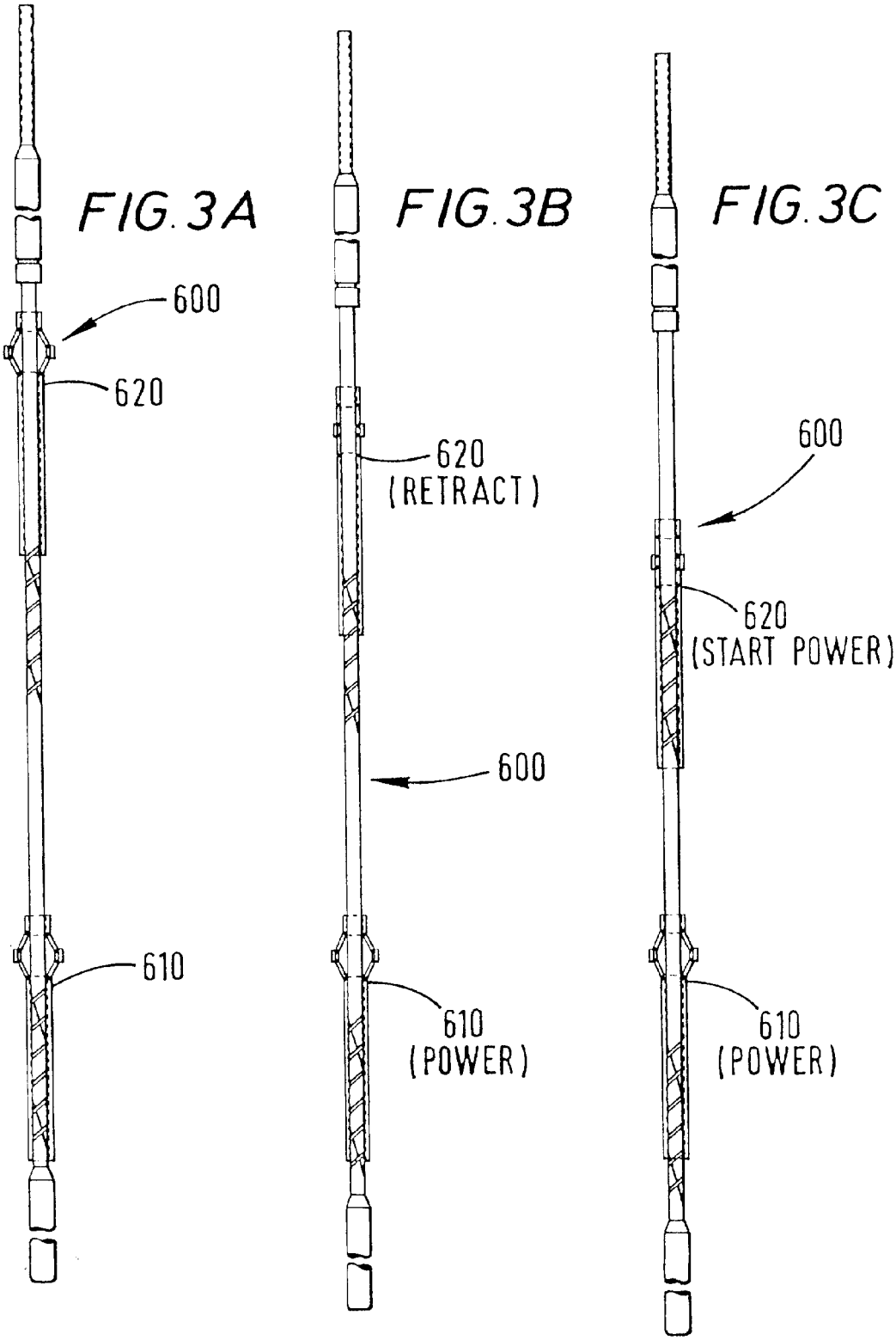
FIGS. 3A–3E illustrate a sequence of operation of the system of FIG. 2.
Figure 3D:
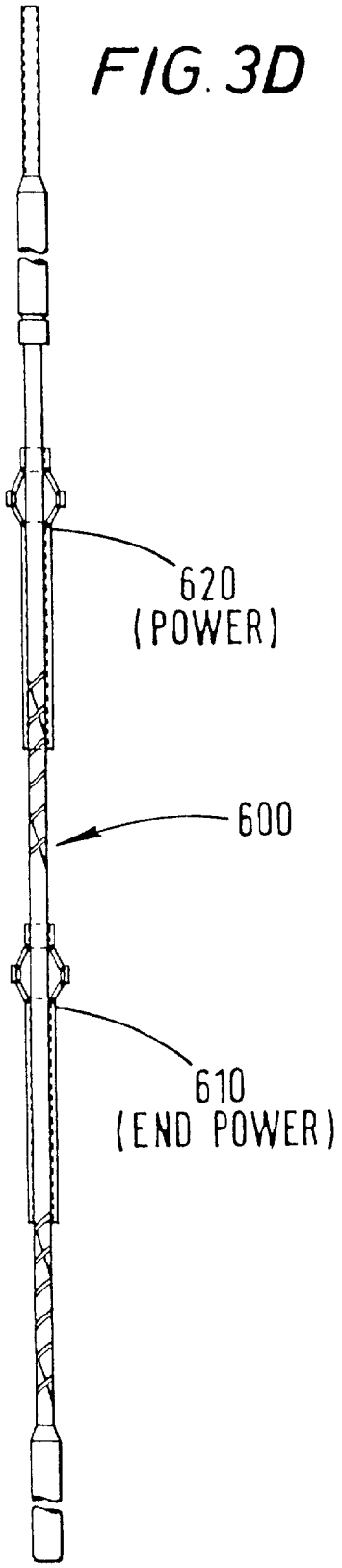
Figure 3E:
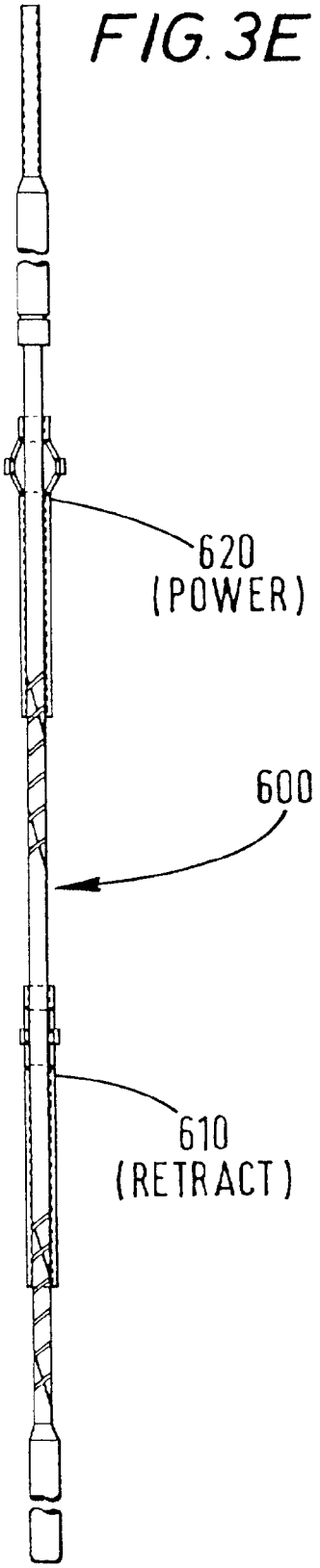

FIGS. 3A–3E illustrate a typical cycle of the system 600. In FIG. 3A the power stroke of the upper tractor unit 620 is ending and the retract stroke of the lower tractor unit 610 is ending. In FIG. 3B the upper tractor unit's slips 634 have been disengaged and the power stroke of the lower tractor unit 610 is commencing. In FIG. 3C the retract stroke of the upper tractor unit 620 is nearing an end and the power stroke of the lower tractor unit 610 is on-going. In FIG. 3D the slips of the upper tractor unit 620 have been set, the power stroke of the upper tractor unit 620 has commenced, the power stroke of the lower tractor unit 610 has ended and its retract stroke is beginning. In FIG. 3E the power stroke of the upper tractor unit 620 is nearing its end and the retract stroke of the lower tractor unit 610 is on-going with the slips of the lower tractor unit 610 disengaged. The lower unit 610 is like the upper unit 620.

A tractor system according to the present invention may be run beneath a "full bore" payload that has a path therethrough or thereon for conveying power fluid to the tractor system.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A tractor system for moving an item through a bore, the item having a top and a bottom, the system comprising a body connected to the item, first setting means on the body for selectively and releasably anchoring the system in a bore, first movement means having a top and a bottom, the first movement means on the body for moving the body and the item, the first movement means having a first power stroke, and the tractor system for moving the item through the bore at a speed of at least 10 feet per minute.

2. The tractor system of claim 1 for moving the item through the bore at a speed of at least 50 feet per minute.

3. The tractor system of claim 1 for moving the item through the bore at a speed of at least 100 feet per minute.

4. The tractor system of claim 1 further comprising second setting means on the body for selectively and releasably anchoring the system in the bore, the second setting means spaced apart from the first setting means, and second movement means on the body having a top, and a bottom, the second movement means providing a second power stroke for moving the body and the item, the second movement means spaced apart from the first movement means.

5. The tractor system of claim 4 wherein the first power stroke and the second power stroke are separated by a time period of no more than three minutes.

6. The wellbore tractor system of claim 4 wherein the first power stroke and the second power stroke are separated by a time period of no more than thirty seconds.

7. The tractor system of claim 4 wherein the item is a tubular string of interconnected tubular members.

8. The tractor system of claim 4 wherein the item is a string of coiled tubing.

9. The tractor system of claim 4 further comprising the item, the item having a lower end.

10. The tractor system of claim 9 further comprising a payload secured to the lower end of the item.

11. The tractor system of claim 10 wherein the payload is a logging tool.

12. The tractor system of claim 4 further comprising first selectively operable control means on the body for selectively controlling the first setting means and the first movement means, and second selectively operable control means on the body for selectively controlling the second setting means and the second movement means.

13. A method for moving an item through a bore with a bore tractor system, the item having a top and a bottom, the bore tractor system comprising a body connected to the item, first setting means on the body for selectively and releasably anchoring the system in a bore, first movement means having a top and a bottom, the first movement means on the body for moving the body and the item, the first movement means having a first power stroke, and the bore tractor system for moving the item through the bore at a speed of at least 10 feet per minute, the method comprising connecting the body to the item, moving the bore tractor system and the item into the bore, powering the first movement means and thereby moving the bore tractor systems, releasably anchoring the bore tractor system in the bore, and moving the bore tractor system and the item through the bore at a speed of at least 10 feet per minute.

14. The method of claim 13 further comprising moving the item through the bore at a speed of at least 50 feet per minute.

15. The method of claim 14 wherein the bore tractor system further comprises first selectively operable control means on the body for selectively controlling the first setting means and the first movement means, and second selectively operable control means on the body for selectively controlling the second setting means and the second movement means, and the method further comprising controlling the first setting means with the first selectively operable control means, and controlling the second setting means with the second selectively operable control means.

16. The method of claim 13 further comprising moving the item through the bore at a speed of at least 100 feet per minute.

17. The method of claim 13 wherein the bore tractor system further comprises second setting means on the body for selectively and releasably anchoring the system in the bore, the second setting means spaced apart from the first setting means, and second movement means on the body having a top and a bottom, the second movement means providing a second power stroke for moving the body and the item, the second movement means spaced apart from the first movement means, and the method further comprising powering the second movement means and thereby moving the bore tractor systems, alternately setting the first setting means and the second setting means, and alternately moving the bore tractor system and the item through the bore with the first movement means and the second movement means.

18. The method of claim 17 wherein the first power stroke temporally overlaps the second power stroke so that the item is moved continuously.

19. The method of claim 17 wherein the first power stroke and the second power stroke are separated by a time period of no more than three minutes.

20. The method of claim 17 wherein the first power stroke and the second power stroke are separated by a time period of no more than thirty seconds.

21. The method of claim 17 wherein the item is a tubular string of interconnected tubular members.

22. The method of claim 17 wherein the item is a string of coiled tubing.

23. The method of claim 17 wherein the item has a lower end, and a payload is secured to the lower end of the item.

24. The method of claim 23 wherein the payload is a logging tool.

* * * * *